US011717846B2

(12) United States Patent
Hughes et al.

(10) Patent No.: US 11,717,846 B2
(45) Date of Patent: Aug. 8, 2023

(54) POOL WATERFALL FLOW DIVERTER

(71) Applicant: Opti Pool Products, LLC, Las Vegas, NV (US)

(72) Inventors: Bill J. Hughes, Pahrump, NV (US); Kevin E. Brehmer, Las Vegas, NV (US)

(73) Assignee: Opti Pool Products, LLC, Las Vegas, NV (US)

( * ) Notice: Subject to any disclaimer, the term of this patent is extended or adjusted under 35 U.S.C. 154(b) by 126 days.

(21) Appl. No.: 17/475,093

(22) Filed: Sep. 14, 2021

(65) Prior Publication Data

US 2023/0080603 A1 Mar. 16, 2023

(51) Int. Cl.
*B05B 17/08* (2006.01)
*E04H 4/14* (2006.01)

(52) U.S. Cl.
CPC ..... *B05B 17/085* (2013.01); *E04H 4/14* (2013.01)

(58) Field of Classification Search
CPC ..... B05B 17/085; E04H 4/14
USPC ..... 239/17–23, 507
See application file for complete search history.

(56) References Cited

U.S. PATENT DOCUMENTS 6,152,381 A * 11/2000 Hones ..... B05B 17/085 239/18

* cited by examiner

*Primary Examiner* — Christopher S Kim
(74) *Attorney, Agent, or Firm* — Imperium Patent Works LLP; T. Lester Wallace

(57) ABSTRACT

A pair of identical, specially-shaped, and specially-sized flow diverters is provided. In order to concentrate the flow of water passing over a waterfall, such as an ornamental backyard spa or swimming pool waterfall, a first flow diverter is attached adjacent a first sidewall of the waterfall structure, and a second flow diverter is attached adjacent a second sidewall of the waterfall structure. Water passing by the sidewalls is directed inwardly away from the sidewalls, thereby narrowing the flow of water over the fall and reducing overspray and reducing mineral build up and scale problems. In one novel aspect, an assemblage (a saleable product) includes a product container, the pair of flow diverters disposed in the container, a tube of silicone adhesive disposed in the container, and a set of printed usage instructions disposed in the container.

9 Claims, 4 Drawing Sheets

WATERFALL WITH TWO FLOW DIVERTERS

WATERFALL WITH TWO FLOW DIVERTERS

TOP-DOWN DIAGRAM OF WATERFALL WITH TWO FLOW DIVERTERS

ASSEMBLAGE

ASSEMBLAGE

PERSPECTIVE VIEW

SIDE A VIEW
(VIEW OF SIDE A)

SIDE B VIEW
(VIEW OF SIDE B)

FRONT VIEW

TOP-DOWN VIEW

SECTIONAL VIEW
(TAKE ALONG LINE A-A')

BOTTOM-UP VIEW
(VIEW OF BOTTOM SIDE)

POOL WATERFALL FLOW DIVERTER

TECHNICAL FIELD

The present invention relates to waterfalls such as ornamental backyard waterfalls as might be found around swimming pools and backyard spas.

BACKGROUND INFORMATION

An ornamental waterfall around a swimming pool can be a pleasing, inviting and calming feature in a backyard. A pool waterfall can be created making the spa higher than the pool water surface and/or by creating an infinity edge whereby a recirculating water reservoir is created below the pool water surface. A waterfall structure can be provided at the water level of the spa so that water from the spa flows out of the spa and over a lip of the waterfall structure and then falls downward to the level of the swimming pool water surface. The water may be made to fall into a recirculating water reservoir (catch basin) or into the swimming pool itself.

FIG. 1 (prior art) is a diagram that illustrates such a waterfall structure at the edge of a spa. The waterfall structure includes a first sidewall 1, a second sidewall 2, and a horizontal surface 3. The horizontal surface has a lip 4. Water from the spa flows from the spa, across the horizontal surface 3, and over the lip 4, and then falls downward to the lower level catch basin. In dry and arid climates in situations where the water contains large amounts of dissolved minerals, over-spray at the edges of the waterfall and evaporation can leave an ugly white scale build up on the waterfall structure or on the side of the catch basin. In the illustration of FIG. 1, there is such a scale build up area 5 on one side of the waterfall and there is another scale build up area 6 on the opposite side of the waterfall. The scale build up is unsightly. It removal is time-consuming, difficult, and expensive.

SUMMARY

A pair of specially-shaped and specially-sized UV resistant plastic "flow diverters" is provided. In order to concentrate the flow of water over a waterfall, a first of the flow diverters is attached adjacent a first sidewall of the waterfall structure. The first flow diverter is positioned close to a lip of the waterfall structure over which a flow of water passes. Accordingly, water of the flow passing by the first sidewall on its way over the fall is diverted inwardly (toward the center of the waterfall water flow) by the first diverter. Likewise, a second of the flow diverters is attached adjacent a second sidewall on the opposite side of the waterfall structure. Water of the flow passing by the second sidewall on its way over the fall is diverted inwardly (toward the center of the waterfall water flow) by the second diverter. The two diverters are typically attached to the waterfall structure using silicone adhesive.

In one novel aspect, an assemblage (for example, a packaged product) comprises a container (such as a plastic bag or small cardboard box), two diverters disposed in the container, a set of printed usage instructions disposed in the container, and a tube of uncured usable silicone adhesive disposed in the container. This assemblage is a product that can be advertised to, and sold to, individuals (for example homeowners, or pool maintenance professionals) who wish to better channel water flow flowing over a waterfall structure (for example, a backyard waterfall feature associated with a spa or swimming pool). The usage instructions explain and illustrate how to install and use the flow diverters.

In a novel method, a pair of specially-shaped flow diverters is placed in a container along with an amount of uncured silicone adhesive and a set of usage instructions. The usage instructions instruct a user how to use the pair of diverters by attaching the diverters to a waterfall structure. The resulting assemblage is a saleable product of particular suitability as an on-line retail product or as a product supplied to a pool product distributor or pool service person or waterfall owner/end user. One method involves the shipping, or otherwise supplying, of such an assemblage to a pool product distributor or pool service person or waterfall owner/end user.

Other structures and methods are disclosed in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 2:
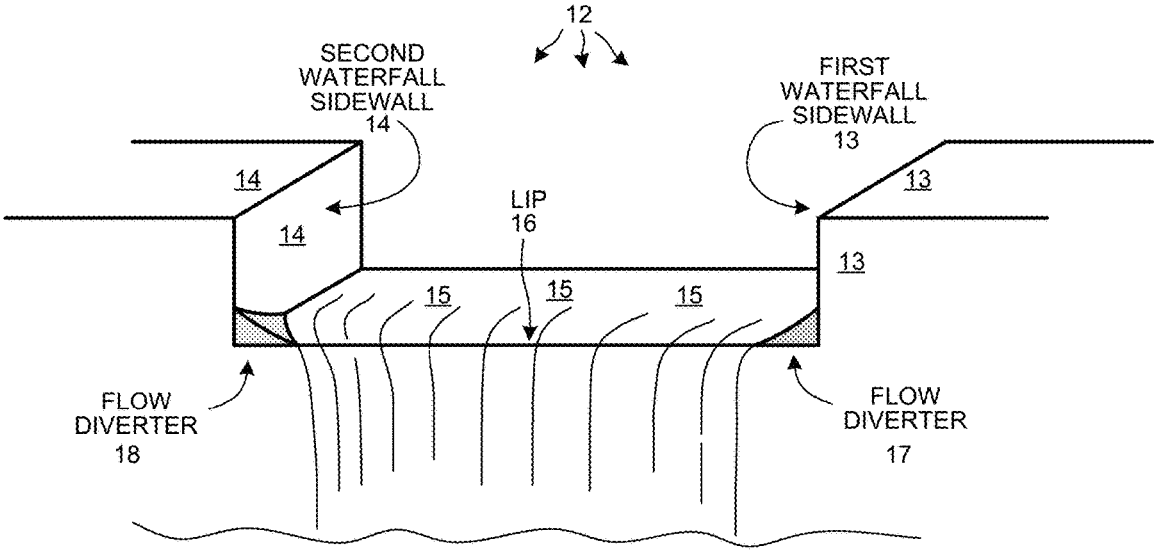
FIG. 2 is a diagram showing how two novel flow diverters may be used with a waterfall structure to reduce the problem illustrated in FIG. 1.
Figure 3:
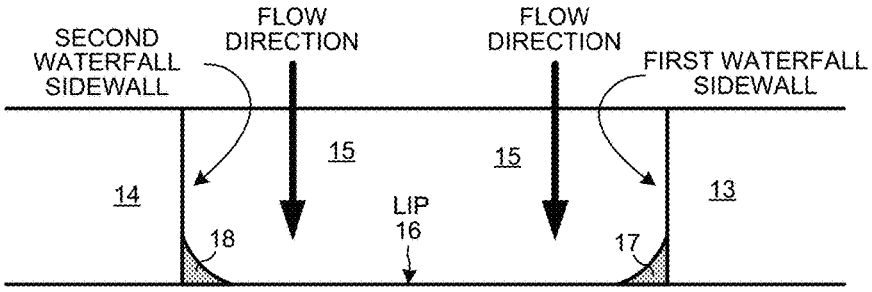
FIG. 3 is a top-down diagram that shows the direction of the flow of water over the waterfall structure illustrated in FIG. 2.

FIG. 2 is a diagram showing how two novel flow diverters 17 and 18 in accordance with one novel aspect may be used with a waterfall structure 12. The waterfall structure 12 is a wall that retains water. The waterfall structure 12 has first waterfall sidewall 13, a second waterfall sidewall 14, and a horizontal surface 15. The horizontal surface 15 has a lip 16 over which a flow of water flows. FIG. 3 is a top-down diagram that shows the direction of flow of the flow of water. The flow of water flows over the lip 16 and then falls downward over the outside of the waterfall structure. In accordance with one novel aspect, a novel first unitary plastic flow diverter 17 is installed as shown adjacent the first waterfall sidewall 13 so that some of the flow of water is diverted by the flow diverter 17 away from the first waterfall sidewall 13 at the lip 16 as illustrated. In the orientation of the illustration, a part of the water flow adjacent the first waterfall sidewall 13 is diverted by the first diverter 17 to the left. Similarly, a novel second unitary plastic flow diverter 18 is installed as shown adjacent the second waterfall sidewall 14 so that some of the flow of water is diverted by the flow diverter 18 away from the second waterfall sidewall 14 at the lip 16 as illustrated. In the orientation of the illustration, a part of the flow adjacent the second waterfall sidewall 14 is diverted by the second diverter 18 to the right. The two flow diverters 17 and 18 together serve to channel the water flow over the waterfall as a narrower flow, as compared to what the flow would be were the diverters 17 and 18 not present.

Figure 4:
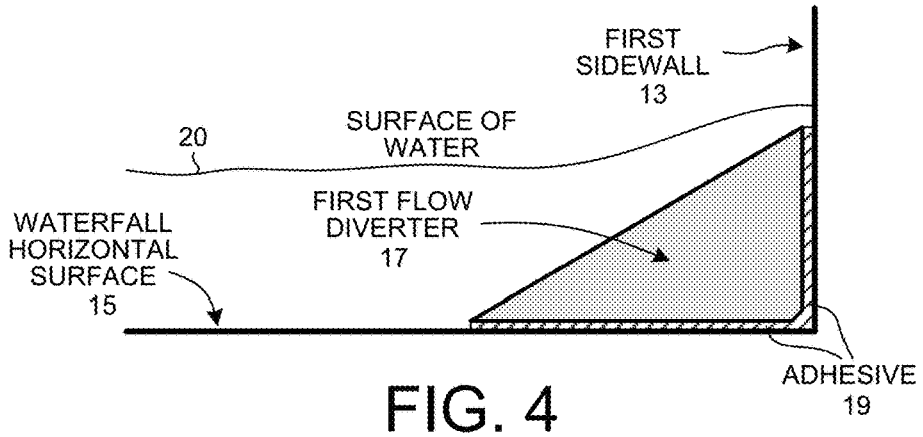
FIG. 4 is a cross-sectional side view of the first flow diverter of FIG. 2 and FIG. 3.

FIG. 4 is a cross-sectional side view of the first flow diverter 17 of FIG. 2 and FIG. 3. The first flow diverter is attached to the horizontal surface 15 and to the first waterfall sidewall 15 by an amount of silicone adhesive 19. The second flow diverter 18 is attached to the horizontal surface 15 and to the second waterfall sidewall 14 in the same way. Line 20 represents the surface of the water flow. Due to the diverter's positioning and shape, the diverter 17 lifts and pushes the portion of the water flow adjacent the first sidewall 13 away from the sidewall 13 toward the center of the waterfall structure.

Figure 1:
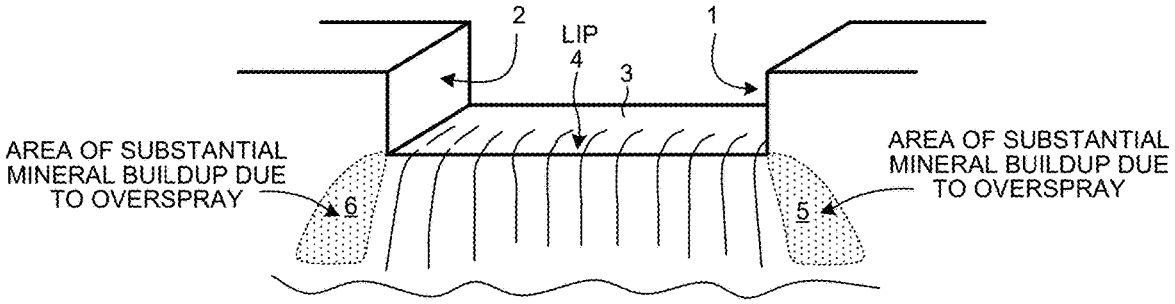
(Prior Art) FIG. 1
FIG. 1 (prior art) is a diagram that illustrates a waterfall structure that has areas of undesirable mineral scale build up.
Figure 5:
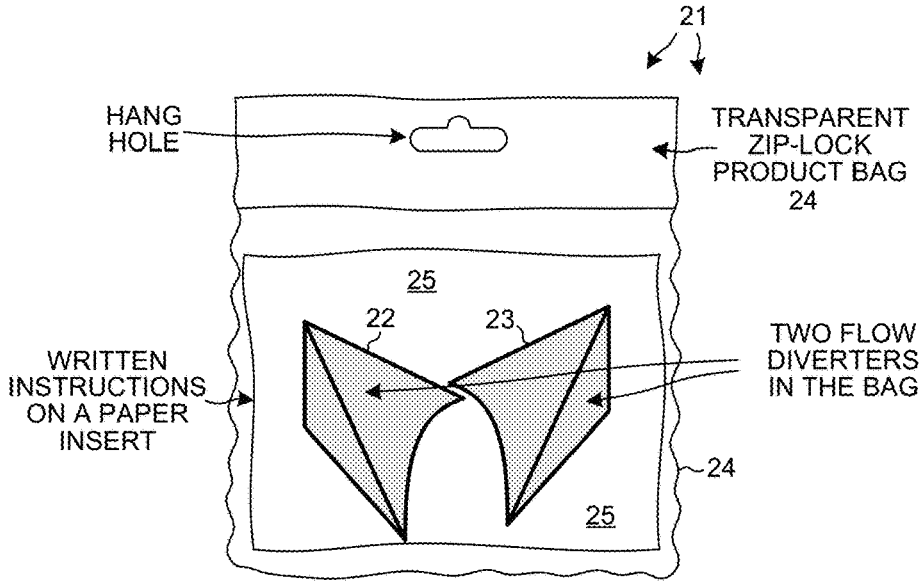
FIG. 5 is a diagram of an assemblage comprising a transparent zip-lock product bag, two identical flow diverters disposed in the bag, and a set of printed usage instructions disposed in the bag.

FIG. 5 is a diagram of an assemblage 21 that includes two identical diverters 22 and 23 and a transparent product bag 24. The diverters 22 and 23 are disposed in the product bag 24 as illustrated along with a piece of paper 25 upon which usage instructions are written. The usage instructions instruct a user (such as a home-owner who owns a waterfall structure that is subject to the scale build up problem illustrated in FIG. 1) how to install the diverters 22 and 23 adjacent the sidewalls of the waterfall structure. The bag 24 may also contain a tube of silicone adhesive (not shown) with which to attach the diverters to the waterfall structure. The bag 24 contains two, and no more than two, of the flow diverters. The bag 24 and its contents is a saleable product that can be advertised, sold, and shipped to a customer.

Figure 6:
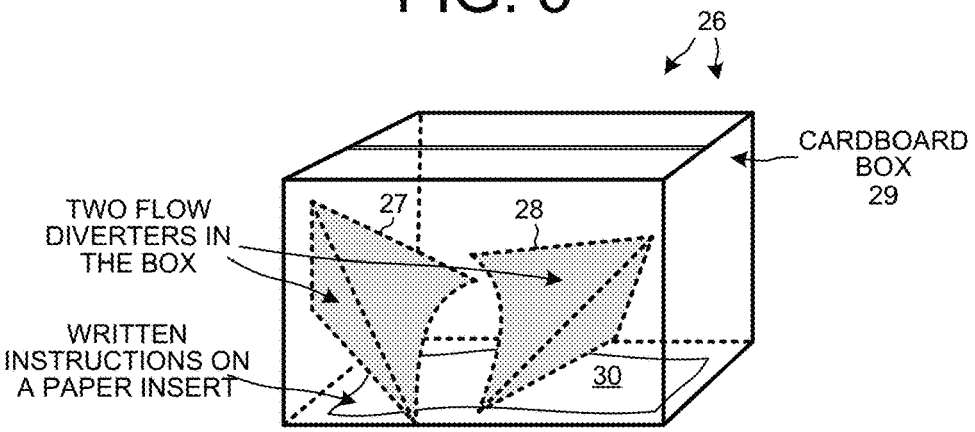
FIG. 6 is a diagram of an assemblage comprising a small cardboard box, two identical flow diverters disposed in the box, and a set of printed usage instructions disposed in the box.

FIG. 6 is a diagram of an assemblage 26 that includes two identical diverters 27 and 28 and a cardboard box 29. The diverters 27 and 28 are disposed in the box 29 as illustrated along with a piece of paper 30 upon which usage instructions are written. The usage instructions instruct a user (such as a home-owner who owns a waterfall structure that has the scale problem illustrated in FIG. 1) how to install the diverters 27 and 28 adjacent the sidewalls of the waterfall structure. The box 29 may also contain a tube of silicone adhesive (not shown) with which to attach the diverters to the waterfall structure. The box 29 contains two, and no more than two, of the flow diverters. The box 29 and its contents is a saleable product that can be advertised, sold, and shipped to a customer.

Figure 7:
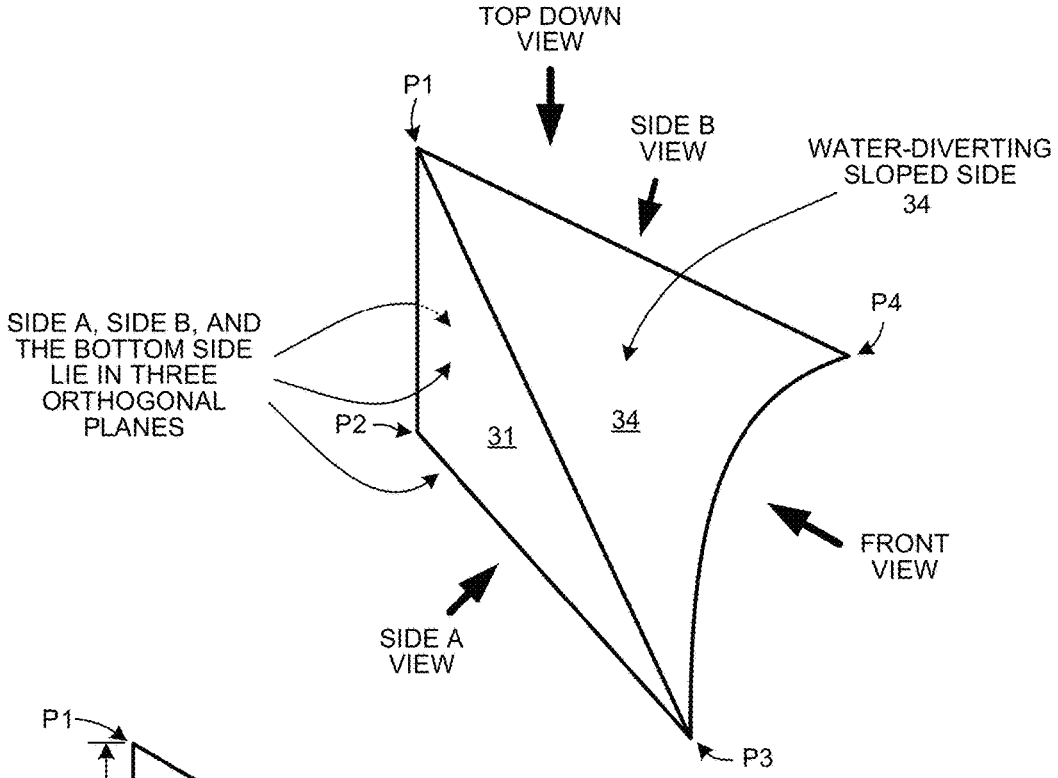
FIG. 7 is a perspective diagram of a novel flow diverter.

FIG. 7 is a perspective diagram of the flow diverter 17 of FIG. 2. As explained above, flow diverters 17 and 18 are of identical shape and construction. Flow diverter 17 has four sides: 1) a first substantially triangular planar side 31 that extends in a first plane, 2) a second substantially triangular planar side 32 that extends in a second plane, 3) a bottom planar side 33 that extends in a third plane, and 4) a water-diverting side 34. The first, second and third planes are substantially orthogonal to one another.

Figure 8:
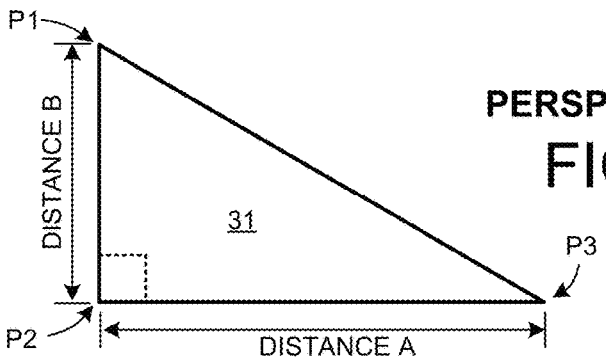
FIG. 8 is a diagram of a first substantially triangular planar side of the novel flow diverter of FIG. 7.

FIG. 8 is a diagram of the first substantially triangular planar side 31. The first substantially triangular planar side 31 has the shape of a scalene right triangle, with distance A between point P2 and point P3 being greater the distance B between point P2 and point P1. Distance A is greater than one inch and less than four inches. Distance B is approximately one inch.

Figure 9:
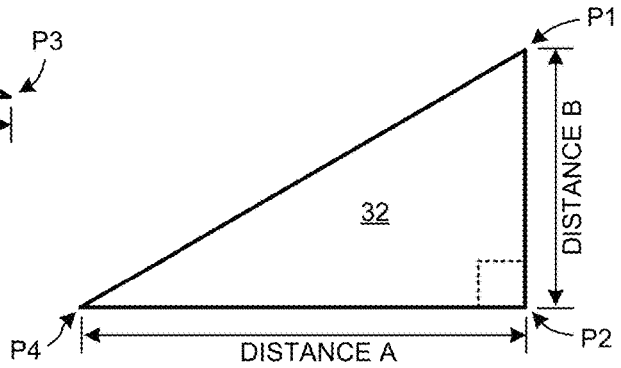
FIG. 9 is a diagram of a second substantially triangular planar side of the novel flow diverter of FIG. 7.

FIG. 9 is a diagram of the second substantially triangular planar side 32. The second substantially triangular planar side 32 and the first substantially triangular planar side 31 have the same identical scalene right triangle shape, with distance A between point P2 and point P4 being greater the distance B between point P2 and point P1. Distance A is greater than one inch and less than four inches. Distance B is approximately one inch.

Figure 10:
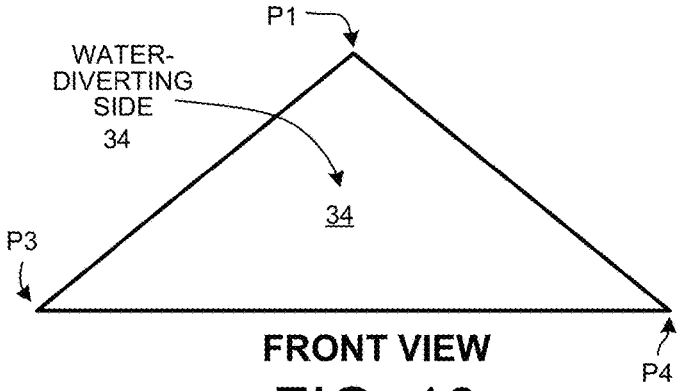
FIG. 10 is a diagram of the water-diverting side of the novel flow diverter of FIG. 7.

FIG. 10 is an elevation diagram of the water-diverting side 34 of flow diverter 17.

Figure 11:
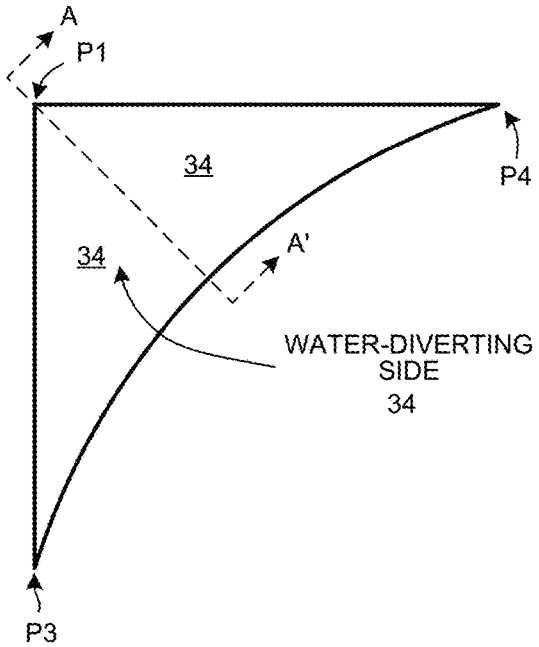
FIG. 11 is a top-down diagram of the novel flow diverter of FIG. 7.

FIG. 11 is a top-down diagram of the flow diverter 17 showing the water-diverting side 34.

Figure 12:
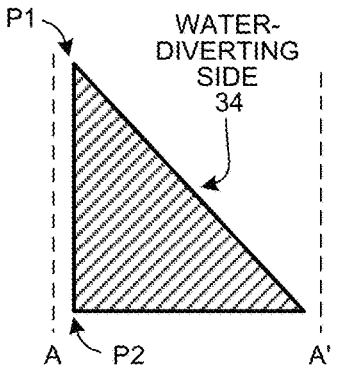
FIG. 12 is a cross-sectional diagram taken along sectional line A-A' of FIG. 11.

FIG. 12 is a cross-sectional diagram taken along sectional line A-A' of FIG. 11.

Figure 13:
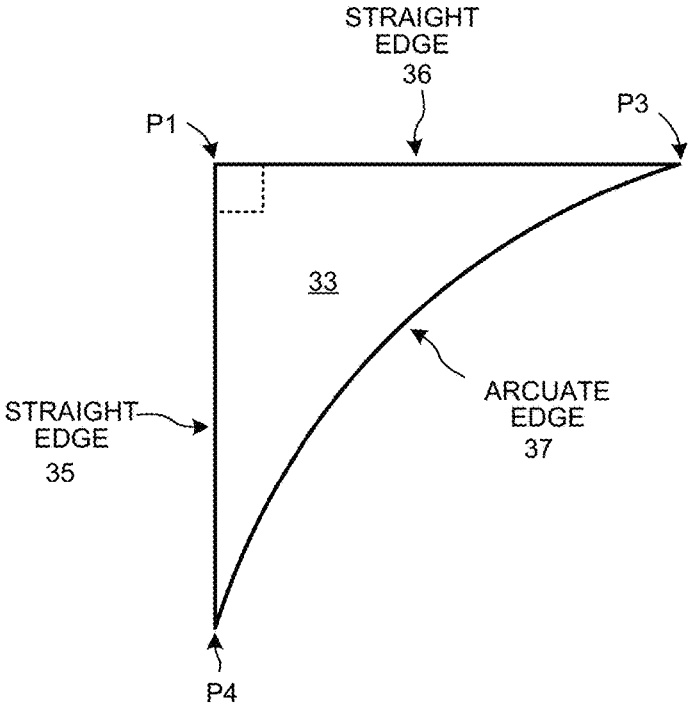
FIG. 13 is a bottom-up diagram showing the bottom planar side of the novel flow diverter of FIG. 7.

FIG. 13 is a bottom-up diagram showing the bottom planar side 33. The bottom planar side 33 has a first straight edge 35, a second straight edge 36, and a third arcuate edge 37.

When the first flow diverter 17 is in place as shown in FIG. 2, it is installed so that first side 31 of first flow diverter 17 abuts the waterfall sidewall 13. The space between the flow diverter 17 and the waterfall structure will typically by filled with silicone adhesive. Point P2 may not be a sharp point, and the edge between P2 and P3 may not be a sharp edge, and the edge between P2 and P4 may not be a sharp edge, so that the flow diverter can be installed against the waterfall sidewall in a situation where the waterfall structure's edge between the first sidewall and the horizontal surface is smoothed and rounded and is not a deep sharp edge. Likewise, the second flow diverter 18 is installed as shown in FIG. 2 so that second side 32 of second flow diverter 18 abuts the waterfall sidewall 14. The space between the flow diverter 18 and the waterfall structure will typically by filled with silicone adhesive. Accordingly, the sides 31, 32 and 33 are described as being substantially planar. Sides 31 and 32 are described as being substantially triangular.

In a preferred embodiment, the flow diverters 17 and 18 are integrally formed and of unitary construction made of UV-resistant injection-molded plastic. Unitary as that term is used here means that all the material making up the object is of the same type and that the object is made at a single time as a single piece of the material, as opposed to being an assembly involving multiple pieces. The material is substantially uniform and the same composition throughout the object. In this way a unitary diverter can be fashioned from a single larger block of material, or a unitary diverter can be molded and formed in one step (for example by injection molding or 3D printing) as a single object.

Although the present invention has been described in connection with certain specific embodiments for instructional purposes, the present invention is not limited thereto. The first and second sides 31 and 32 need not be of strictly triangular shape, but for example may have two straight edges and one arcuate edge, and may have one or more rounded or blunted corners. The shape of the first and second sides 31 and 32 may be varied from that of a triangle in order to facilitate better abutting of an edge of the diverter (for example, edge P1-P3 or edge P1-P4) to the waterfall structure while at the same time providing space for an amount of securing silicone adhesive. Accordingly, various modifications, adaptations, and combinations of various features of the described embodiments can be practiced without departing from the scope of the invention as set forth in the claims.

What is claimed is:

1. An assemblage comprising:

a container;

a first unitary plastic flow diverter that is disposed in the container, wherein the first unitary plastic flow diverter has a first substantially triangular planar side that extends in a first plane, a second substantially triangular planar side that extends in a second plane, a bottom planar side that extends in a third plane, and a water-diverting side, wherein the first, second and third planes are substantially orthogonal to one another, wherein the bottom side has a first straight edge, a second straight edge, and a third arcuate edge, and wherein the first straight edge of the bottom side and the second straight edge of the bottom side are of identical length A, wherein the first unitary plastic flow diverter has a height B measured with respect to the third plane, wherein A is greater than B; and a second unitary plastic flow diverter that is disposed in the container along with the first unitary plastic flow diverter, wherein the second unitary plastic flow diverter has the same identical three-dimensional shape as the first unitary plastic flow diverter, wherein the first and second unitary plastic flow diverters are the only unitary plastic flow diverters in the container.

2. The assemblage of claim 1, wherein the assemblage further comprises:

written usage instructions, wherein the written usage instructions are written on paper, wherein the paper is disposed in the container along with the first and second unitary plastic flow diverters.

3. The assemblage of claim 1, wherein the assemblage further comprises:

written usage instructions that are printed on the container.

4. The assemblage of claim 1, wherein the container is taken from the group consisting of: a plastic bag container, a cardboard box container.

5. The assemblage of claim 1, wherein the container is at least somewhat transparent such that the first and second unitary plastic flow diverters are visible from outside the container.

6. The assemblage of claim 1, wherein the assemblage further comprises:

a tube of silicone adhesive.

7. The assemblage of claim 1, wherein length A is greater than one inch and is less than four inches.

8. A structure, comprising:

a first unitary plastic flow diverter, wherein the first unitary plastic flow diverter has a first substantially triangular planar side that extends in a first plane, a second substantially triangular planar side that extends in a second plane, a bottom planar side that extends in a third plane, and a water-diverting side, wherein the first, second and third planes are substantially orthogonal to one another, wherein the bottom side has a first straight edge, a second straight edge, and a third arcuate edge;

a second unitary plastic flow diverter that has the same identical three-dimensional shape as the first unitary plastic flow diverter; and a waterfall structure that has a first sidewall, a second sidewall, and a lip that extends from the first sidewall to the second sidewall, wherein a flow of water flows over the lip, wherein the first unitary plastic flow diverter is mounted to the waterfall structure such that its first substantially triangular planar side abuts the first sidewall and such that its water-diverting side is in the flow of water and diverts some of the flow away from the first sidewall, wherein the second unitary plastic flow diverter is mounted to the waterfall structure such that its second substantially triangular planar side abuts the second sidewall and such that its water-diverting side is in the flow of water and diverts some of the flow away from the second sidewall.

9. The structure of claim 8, wherein both the first and second unitary plastic flow diverters are attached to the waterfall structure with silicone adhesive.

* * * * *